US010517406B2

(12) United States Patent
McAlpine

(10) Patent No.: US 10,517,406 B2
(45) Date of Patent: Dec. 31, 2019

(54) CUSHION WEDGE

(71) Applicant: Gisele McAlpine, New York, NY (US)

(72) Inventor: Gisele McAlpine, New York, NY (US)

( * ) Notice: Subject to any disclaimer, the term of this patent is extended or adjusted under 35 U.S.C. 154(b) by 0 days.

(21) Appl. No.: 15/857,069

(22) Filed: Dec. 28, 2017

(65) Prior Publication Data

US 2018/0177303 A1 Jun. 28, 2018

Related U.S. Application Data

(60) Provisional application No. 62/439,670, filed on Dec. 28, 2016.

(51) Int. Cl.

| | |
|---|---|
| ***B60N 2/75*** | (2018.01) |
| ***A47C 20/02*** | (2006.01) |
| ***A47C 20/04*** | (2006.01) |
| ***A47C 27/00*** | (2006.01) |
| ***A47C 31/00*** | (2006.01) |
| ***A47C 27/14*** | (2006.01) |

(52) U.S. Cl.

CPC ..... *A47C 20/027* (2013.01); *A47C 20/04* (2013.01); *A47C 27/002* (2013.01); *A47C 27/14* (2013.01); *A47C 31/00* (2013.01)

(58) Field of Classification Search

CPC ..... A47C 20/027; A47C 20/04; A47C 27/002; A47C 27/14; A47C 31/00

USPC ..... 297/411.23, 411.24, 464; 248/118, 351, 248/188.9, 291.1

See application file for complete search history.

(56) References Cited

U.S. PATENT DOCUMENTS

| | | | | | |
|---|---|---|---|---|---|
| 1,019,658 | A * | 3/1912 | King | B60N 2/787 | 297/411.23 |
| 1,422,502 | A * | 7/1922 | Wark | G09F 21/04 | 248/291.1 |
| 1,890,102 | A * | 12/1932 | Urquhart | B60N 2/787 | 297/411.23 |
| 1,909,620 | A * | 5/1933 | Lang | E06C 7/46 | 248/188.9 X |
| 2,043,626 | A * | 6/1936 | Morrison | B60N 2/787 | 297/411.24 |
| 2,086,244 | A * | 7/1937 | Smith | B60N 2/787 | 297/411.24 |
| 2,208,713 | A * | 7/1940 | Wilhelm | A47G 9/00 | 5/513 |
| 2,296,628 | A * | 9/1942 | Coppock | B60N 2/787 | 297/411.23 |
| 2,505,463 | A * | 4/1950 | Crane | B60N 2/787 | 297/411.24 |
| 2,592,702 | A * | 4/1952 | Sprung | B60N 2/787 | 297/411.32 |

(Continued)

*Primary Examiner* — Rodney B White

(74) *Attorney, Agent, or Firm* — Global Intellectual Property Agency, LLC; Daniel Boudwin

(57) ABSTRACT

A cushion wedge for filling a gap between furniture cushions. The cushion wedge includes an elongated body having an upper side and a lower side. A pair of legs are disposed on the lower side at a first end of the elongated body and a second end of the elongated body. The pair of legs are inserted between adjacent furniture cushions such that the elongated body rests flush with the cushions, such that the gap between the cushions is filled. A support member is disposed at a terminal end of each of the pair of legs, wherein the support member is pivotally affixed to the terminal end about a hinge to provide stability to the elongated body.

5 Claims, 3 Drawing Sheets

(56) References Cited

U.S. PATENT DOCUMENTS 2,658,560 A * 11/1953 Cawthon ..... B60N 2/787 297/411.24
2,659,423 A * 11/1953 Haley ..... B60N 2/787 297/411.24
2,751,968 A * 6/1956 Fleming ..... B60N 2/787 297/411.24
3,614,156 A * 10/1971 Sarvas ..... A47C 31/11 297/224
3,893,729 A * 7/1975 Sherman ..... B60N 2/062 244/118.6
4,069,995 A * 1/1978 Miller ..... A47C 1/03 248/118.1
4,118,812 A * 10/1978 Pangburn ..... A47D 15/006 5/513
4,159,148 A * 6/1979 Schulz ..... B60N 2/753 297/411.32
D253,568 S * 12/1979 Brink ..... D6/716.2
4,668,011 A * 5/1987 Fister, Jr. ..... A47C 31/11 297/218.5
4,819,957 A * 4/1989 Printy ..... B62H 1/02 248/188.9
4,822,103 A * 4/1989 Stenvall ..... A47C 1/03 248/118
4,938,401 A * 7/1990 Weisbrodt ..... B60R 7/043 108/44
5,000,168 A * 3/1991 Lipson ..... A61F 5/01 128/845
5,054,837 A * 10/1991 Chapman ..... B60N 2/28 160/351
5,123,707 A * 6/1992 Wurzell ..... B60N 2/90 297/464 X
5,129,612 A * 7/1992 Beaupre ..... B60R 7/02 224/539
5,255,958 A * 10/1993 Frischmann ..... B60N 2/28 297/464 X
5,302,000 A * 4/1994 Ayotte ..... A47C 7/68 297/411.23 X
D361,383 S * 8/1995 Lipson ..... D24/183
5,464,102 A * 11/1995 LeBlanc ..... A47F 13/085 211/12
D375,163 S * 10/1996 Lipson ..... D24/183
5,560,058 A * 10/1996 Smith ..... A47C 21/00 5/513
D376,428 S * 12/1996 Lipson ..... D24/183
5,601,271 A * 2/1997 Janowski ..... B60P 7/0892 248/503
5,971,487 A * 10/1999 Passehl ..... B60N 2/28 297/464
6,022,072 A 2/2000 Moyer
6,026,812 A * 2/2000 Lipson ..... A61F 5/0585 128/882
6,142,574 A * 11/2000 Alexander ..... B60N 2/91 297/464
6,260,903 B1 * 7/2001 von der Heyde .... B60N 2/2821 296/24.46
6,644,736 B2 * 11/2003 Nguyen ..... B64D 11/06 160/84.07
6,908,157 B1 * 6/2005 Avedissian ..... A47C 7/546 297/411.24
6,957,463 B2 * 10/2005 Falwell ..... A61G 7/075 5/646
7,320,454 B2 * 1/2008 Lee ..... F16M 11/10 248/291.1 X
D595,980 S * 7/2009 Walters ..... D6/601
7,562,931 B2 * 7/2009 Stojanovic ..... B60N 2/3013 296/24.4
7,568,759 B2 * 8/2009 Schurg ..... B64D 11/06 297/184.1
7,736,711 B2 6/2010 Dobelle
8,272,674 B2 * 9/2012 Vance ..... B60N 2/91 296/24.46
8,336,963 B1 * 12/2012 DeMonaco ..... B60N 2/787 297/411.23
8,590,080 B1 * 11/2013 Staresinic ..... A47C 21/00 248/125.9
8,662,367 B2 * 3/2014 Panaro ..... B60R 11/00 224/542
8,672,401 B2 * 3/2014 Schreiber ..... B60N 2/7005 297/182
8,714,655 B2 * 5/2014 Cahall ..... B60N 2/91 297/464
D728,798 S * 5/2015 Moon ..... D24/184
9,216,674 B1 * 12/2015 Garib ..... B60N 2/91
9,428,932 B2 * 8/2016 Daly ..... A47C 7/62
9,434,282 B2 * 9/2016 Kronenberger ..... B60N 2/90
9,580,031 B2 * 2/2017 Kalis ..... B60N 3/10
9,586,687 B2 * 3/2017 Abreu ..... B64D 11/0606
9,756,946 B2 * 9/2017 Chang ..... B60N 2/787
9,956,898 B1 * 5/2018 Dellock ..... B60N 2/90
10,059,238 B1 * 8/2018 Salter ..... B60N 2/90
10,117,519 B2 * 11/2018 Chang ..... A47C 7/546
10,118,527 B2 * 11/2018 Ott ..... B60N 2/90
2002/0180229 A1 * 12/2002 Wheat ..... B60P 3/03 296/24.46
2005/0194827 A1 * 9/2005 Dowty ..... B60N 2/62 297/411.3
2006/0065793 A1 3/2006 Denny
2009/0315381 A1 * 12/2009 Longnecker ..... B64D 11/0646 297/411.23
2010/0148563 A1 6/2010 Fera
2011/0126353 A1 * 6/2011 Veenendaal ..... A47C 21/00 5/428
2012/0273637 A1 * 11/2012 Huang ..... F16M 11/041 248/291.1
2013/0249259 A1 9/2013 Marvin et al.
2014/0252821 A1 * 9/2014 Friedlander ..... B64D 11/0646 297/232 X
2016/0355109 A1 * 12/2016 Geraty ..... B60N 2/90

* cited by examiner

CUSHION WEDGE

CROSS REFERENCE TO RELATED APPLICATIONS

This application claims the benefit of U.S. Provisional Application No. 62/439,670 filed on Dec. 28, 2016. The above identified patent application is herein incorporated by reference in its entirety to provide continuity of disclosure.

BACKGROUND OF THE INVENTION

The present invention relates to a cushion wedge. Specifically, the present invention relates to a cushion wedge insertable into the gap between furniture cushions having pivotable support members.

Many people wind up sleeping on a couch at one point or another, however sleeping on a couch can be uncomfortable. Cushion marks may wind up being made on the body of the person, and the person can lack sufficient back support as they fall between the cushions of the couch. Due to these reasons, it can be difficult for a person to get restful sleep on a couch, which can lead to tired feelings and frustration. Therefore, a cushion wedge is that provides support between couch cushions such that a user can get a restful night's sleep on the couch is needed.

In light of the devices disclosed in the known art, it is submitted that the present invention substantially diverges in design elements from the known art and consequently it is clear that there is a need in the art for an improvement to existing cushion wedges. In this regard, the instant invention substantially fulfills these needs.

SUMMARY OF THE INVENTION

In view of the foregoing disadvantages inherent in the known types of cushion wedges now present in the prior art, the present invention provides a cushion wedge wherein the same can be utilized for providing convenience for the user when providing back support when resting on a couch.

The present system comprises an elongated body having an upper side and a lower side, wherein a pair of legs are disposed on the lower side at a first end of the elongated body and a second end of the elongated body. A support member is disposed at a terminal end of each of the pair of legs, wherein the support members are pivotally affixed to the terminal end about a hinge. In some embodiments, the support members are configured to move between a position parallel to the pair of legs and a position perpendicular to the pair of legs. In another embodiment, the hinges further comprise a spring configured to bias the support members towards the position perpendicular to the pair of legs. In other embodiments, the pair of legs are telescopic and are configured to move between an extended position and a retracted position. In yet another embodiment, the elongated body tapers from the upper side to the lower side. In some embodiments, a padded covering is disposed about the elongated body. In another embodiment, the padded covering comprises a foam material.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
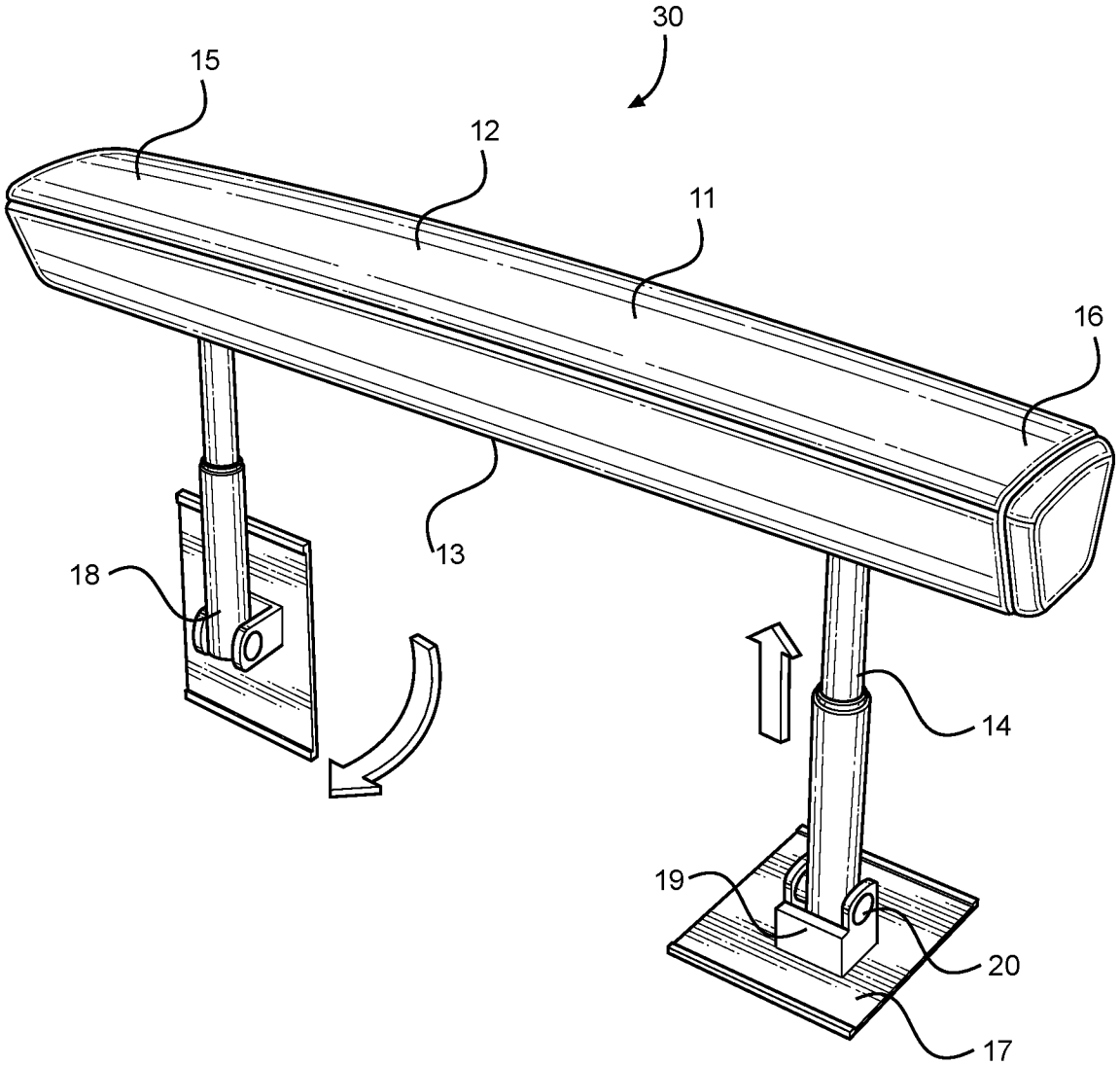
FIG. 1 shows a perspective view of an embodiment of the cushion wedge.

Reference is made herein to the attached drawings. Like reference numerals are used throughout the drawings to depict like or similar elements of the cushion wedge. The figures are intended for representative purposes only and should not be considered to be limiting in any respect.

Referring now to FIG. 1, there is shown a perspective view of an embodiment of the cushion wedge. The cushion wedge 30 comprises an elongated body 11 having an upper side 12 and a lower side 13. In the illustrated embodiment, the elongated body 11 tapers from the upper side 12 towards the lower side 13. In this way, the elongated body 11 can easily be inserted between a pair of adjacent cushions on a couch or other piece of furniture. Additionally, the greater width of the upper side 12 provides a larger surface area for contact with the back of a user when the cushion wedge 30 is in use, thereby increasing comfort and minimizing any gaps between the adjacent couch cushions. In the illustrated embodiment, a length of the elongated body 11 is configured to extend along an entire lateral side of each of the adjacent couch cushions, such that the entire length of the gap is filled by the elongated body 11. Furthermore, in the illustrated embodiment, each end of the elongated body 11 comprises a flat surface, such that the end does not protrude beyond the cushions.

The cushion wedge further comprises a pair of legs 14 extending perpendicularly away from the lower side 13 of the elongated body 11. In the illustrated embodiment, each of the pair of legs 14 extends from a center of the lower side 13 at a first end 15 and a second end 16 of the elongated body, respectively. This provides support for the elongated body 11 at both ends 15, 16 thereof, as well as on opposing lateral sides of the elongated body 11. In the illustrated embodiment, the pair of legs 14 comprise a plurality of segments in a telescopic arrangement, the pair of legs 14 configured to move between an extended position and a retracted position. In this way, the pair of legs 14 are adjustable in length, allowing the cushion wedge 30 to be used interchangeably with various thicknesses of couch cushions. In some embodiments, the pair of legs 14 are configured to lock into positions at intervals along the length of the pair of legs 14, such as, but not limited to a ball-detent mechanism, such that the pair of legs 14 can maintain a particular position. In this way, the pair of legs 14 can lock at a desired height such that weight placed upon the elongated body 11 does not depress the pair of legs 14.

The cushion wedge 30 further comprises a support member 17 adapted to maintain the elongated body 11 positioned between the joining cushions when in use. In the illustrated embodiment, each support member 17 is pivotally affixed to a terminal end 18 of each of the pair of legs 14 about a hinge 19. The support members 17 are configured to move between a position perpendicular to the pair of legs 14 and a position parallel to the pair of legs 14 wherein the support members 17 are configured to provide an increased surface area of contact between the couch and the support members 17 when in the position perpendicular to the pair of legs 14. In the illustrated embodiment, the support members 17 are further spring-biased towards the position perpendicular to the pair of legs 14 via a spring 20 disposed at the hinge 19. In this way, the support members 17 are configured to automatically deploy towards the perpendicular position when inserted between adjacent couch cushions. In the illustrated embodiment, the support members 17 comprise a substantially flat, rectangular shape, such that the support members 17 can rest flush against an underside of the adjacent cushions to provide support to the elongated body 11. In some embodiments, the width of each support member 17 is greater than a width of the elongated body such that the cushion wedge is not easily dislodged.

Figure 2:
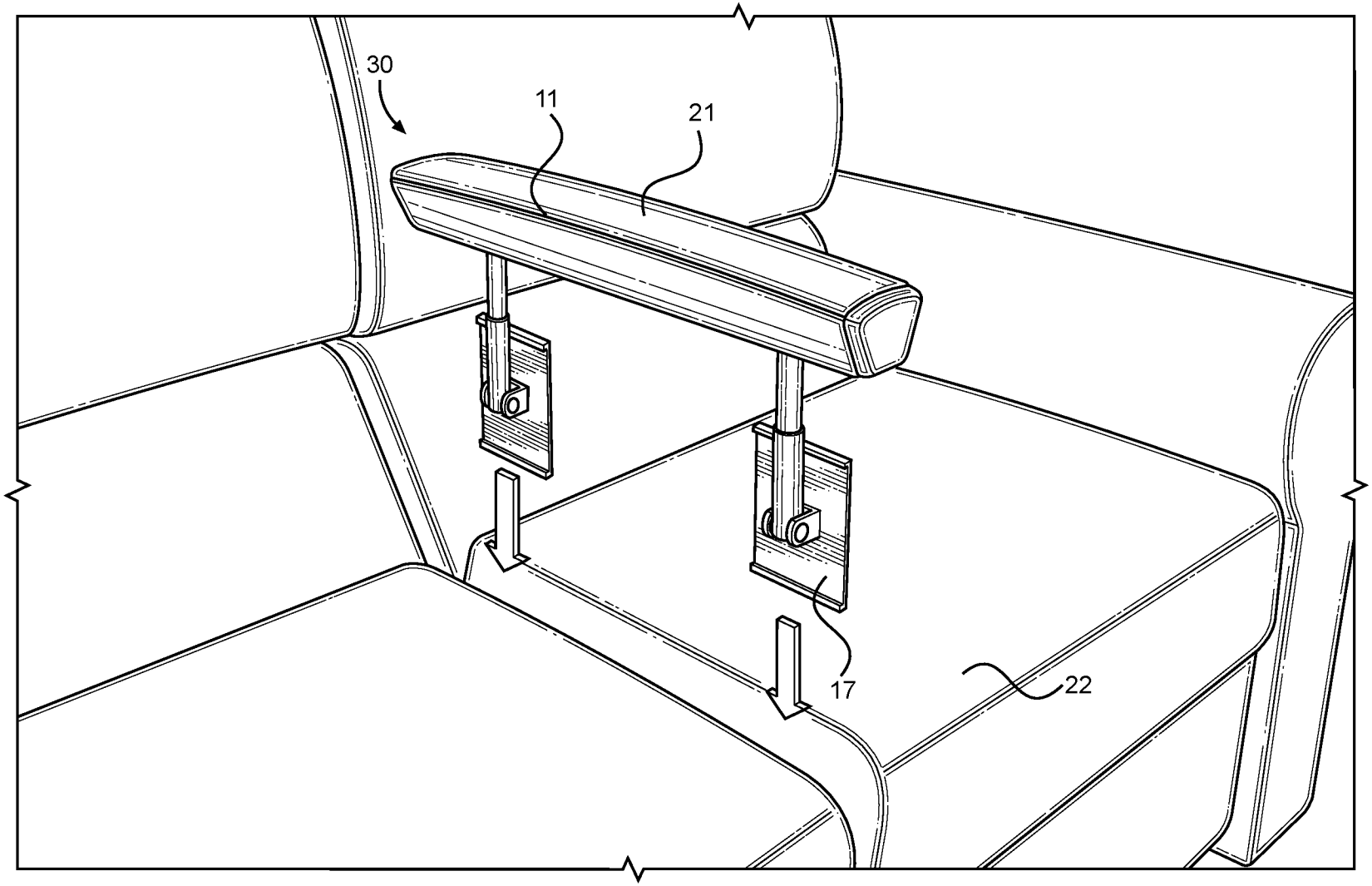
FIG. 2 shows a perspective view of an embodiment of the cushion wedge being inserted between furniture cushions.

Referring now to FIG. 2, there is shown a perspective view of an embodiment of the cushion wedge being inserted between furniture cushions. In use, as shown in the illustrated embodiment, the cushion wedge 30 is inserted between a pair of adjacent couch cushions 22. The support members 17 are positioned in the parallel position to easily slide between the pair of adjacent couch cushions 22. In the illustrated embodiment, the cushion wedge 30 further comprises a padded covering 21 disposed about the elongated body 11. The padded covering 21 is configured to provide comfort to a user, the padding configured to mimic the cushioning provided by the adjacent couch cushions 22. In some embodiments, the padding comprises a foam material. In the illustrated embodiment, the padded covering 21 comprises a similar color and material to the couch so as to allow the cushion wedge 30 to blend in with the couch such that its presence is difficult to detect.

Figure 3:
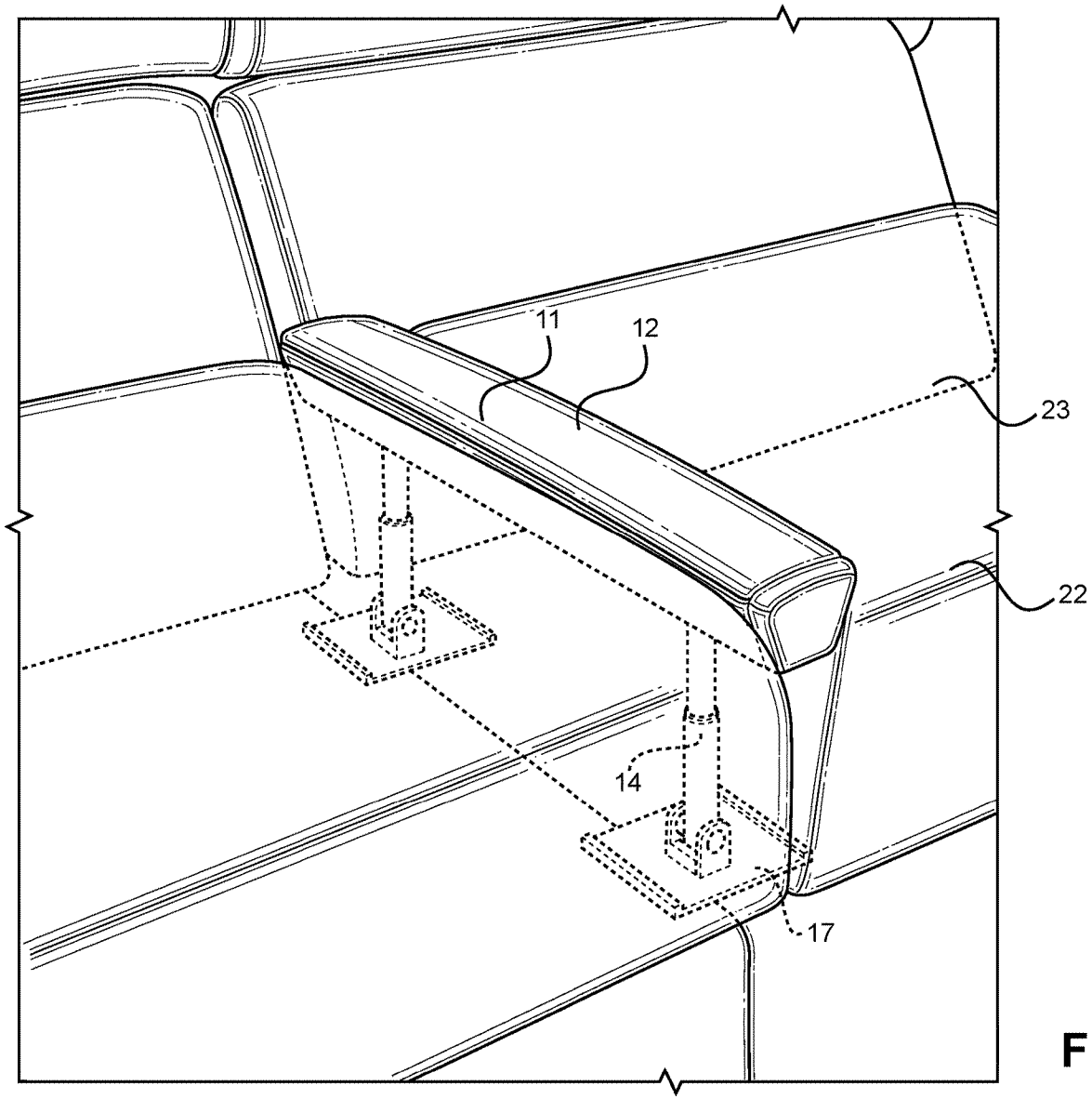
FIG. 3 shows a semi-transparent view of an embodiment of the cushion wedge inserted between furniture cushions.

Referring now to FIG. 3, there is shown a semi-transparent view of an embodiment of the cushion wedge inserted between furniture cushions. After being inserted between adjacent couch cushions 22, the support members 17 are then positioned in the perpendicular position so as to provide increase support for the pair of legs 14 and the elongated body 11. The support members 17 are configured to rest beneath the adjacent couch cushions 22 further anchoring the position of the elongated body 11. In the illustrated embodiment, the pair of legs 14 can be adjusted in length, such that the upper side 12 of the elongated body 11 rests flush with an upper surface 23 of the couch cushions 22. In this way, the elongated body 11 further blends with the couch, while providing an even surface across the upper surface 23 of one couch cushion 22, the upper side 12 of the elongated body 11, and the upper surface 23 of the adjacent couch cushion 22 for the user to rest upon.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cushion wedge, comprising:

an elongated body having an upper side and a lower side;

wherein the elongated body tapers from the upper side towards the lower side;

a pair of legs disposed on the lower side at a first end and a second end of the elongated body;

a support member disposed at a terminal end of each of the pair of legs;

wherein the support members are pivotally affixed to the terminal end about a hinge;

wherein the support members are configured to move between a position parallel to eh pair of legs and a position perpendicular to the pair of legs;

wherein the hinges further comprise a spring configured to bias the support members towards the position perpendicular to the pair of legs.

2. The cushion wedge of claim 1, wherein the pair of legs are telescopic, such that the pair of legs are configured to move between an extended position and a retracted position.

3. The cushion wedge of claim 1, further comprising a padded covering disposed about the elongated body.

4. The cushion wedge of claim 1, wherein an end face of the elongated body comprises a flat surface.

5. The cushion wedge of claim 4, wherein the padded covering comprises a foam material.

* * * * *